US009150822B2

(12) United States Patent
Clowes et al.

(10) Patent No.: US 9,150,822 B2
(45) Date of Patent: Oct. 6, 2015

(54) FABRIC CONDITIONERS

(75) Inventors: Elizabeth Ann Clowes, Wirral (GB); Michel Gilbert Jose Delroisse, Port Sunlight (GB); Denis James Gregory, Wirral (GB); Robert Allan Hunter, Wirral (GB); Karl Gareth Kean Jones, Wirral (GB); James Merrington, Wirral (GB); Mark Nicholas Newman, Wirral (GB); Janette Perry, Wirral (GB); Shaun Charles Walsh, Wirral (GB); Jenny Wiggans, Ontario (CA)

(73) Assignee: Conopco, Inc., Englewood Cliffs, NJ (US)

( * ) Notice: Subject to any disclaimer, the term of this patent is extended or adjusted under 35 U.S.C. 154(b) by 142 days.

(21) Appl. No.: 13/990,053

(22) PCT Filed: Nov. 4, 2011

(86) PCT No.: PCT/EP2011/069465

§ 371 (c)(1),
(2), (4) Date: Jul. 29, 2013

(87) PCT Pub. No.: WO2012/072370

PCT Pub. Date: Jun. 7, 2012

(65) Prior Publication Data

US 2014/0057827 A1 Feb. 27, 2014

(30) Foreign Application Priority Data

Dec. 3, 2010 (EP) ..... 10193693

(51) Int. Cl.

| | |
|---|---|
| ***C11D 1/62*** | (2006.01) |
| ***C11D 3/00*** | (2006.01) |
| ***C11D 1/835*** | (2006.01) |
| *C11D 1/72* | (2006.01) |

(52) U.S. Cl.

CPC ..... *C11D 3/0015* (2013.01); *C11D 1/835* (2013.01); *C11D 1/62* (2013.01); *C11D 1/72* (2013.01)

(58) Field of Classification Search

CPC ..... C11D 3/0015; C11D 1/46
USPC ..... 510/522, 527
See application file for complete search history.

(56) References Cited

U.S. PATENT DOCUMENTS

| | | | | |
|---|---|---|---|---|
| 3,215,636 | A | 11/1965 | Hagge et al. | |
| 3,356,612 | A | 12/1967 | Guthrie | |
| 5,409,621 | A | 4/1995 | Ellis et al. | |
| 5,726,144 | A | 3/1998 | Dewez | |
| 6,063,754 | A | 5/2000 | Ness | |
| 2003/0064904 | A1 * | 4/2003 | Granger et al. | 510/329 |
| 2003/0139314 | A1 | 7/2003 | Buron | |
| 2003/0216282 | A1 | 11/2003 | Martens et al. | |
| 2003/0220217 | A1 | 11/2003 | McHattie | |
| 2004/0097396 | A1 * | 5/2004 | Peeters et al. | 510/515 |
| 2006/0252669 | A1 * | 11/2006 | Heibel et al. | 510/515 |
| 2008/0176784 | A1 | 7/2008 | Clowes | |

FOREIGN PATENT DOCUMENTS

| | | | |
|---|---|---|---|
| DE | 4420188 | A1 | 12/1995 |
| DE | 102004046282 | A1 | 3/2006 |
| DE | 102007021792 | A1 | 11/2008 |
| EP | 0018039 | B1 | 3/1984 |
| EP | 0280550 | B1 | 10/1990 |
| EP | 0922755 | A1 | 6/1999 |
| EP | 1279726 | A1 | 1/2003 |
| EP | 1370634 | B1 | 6/2005 |
| EP | 2053119 | A1 | 4/2009 |
| GB | 1041189 | A | 9/1966 |
| WO | WO9950378 | A1 | 10/1999 |
| WO | WO02072745 | A1 | 9/2002 |
| WO | WO03012019 | A1 | 2/2003 |
| WO | WO0305413 | A1 | 7/2003 |
| WO | WO2006124338 | A1 | 11/2006 |
| WO | WO2006133791 | A2 | 12/2006 |
| WO | WO2010079100 | A1 | 7/2010 |

OTHER PUBLICATIONS

IPRP2 in PCTEP2011069411, Jan. 31, 2013.
Sokolowski et al., "Chemical Structure and Surface Activity", Tenside Surfactants Detergents, 1993, vol. 6, pp. 417-421.
PCT International Search Report in PCT application PCT/EP2011/069465 dated Feb. 14, 2012 with Written Opinion.
European Search Report in EP application EP 10 19 3693 dated May 12, 2011.
PCT International Search Report in PCT application PCT/EP2011/069411 dated Feb. 10, 2012 with Written Opinion.
European Search Report in EP application EP 10 19 3691 dated May 6, 2011.
PCT International Search Report in PCT application PCT/EP2011/069414 dated Feb. 10, 2012 with Written Opinion.
European Search Report in EP application EP 10 19 3695 dated May 10, 2011.
European Search Report in EP application EP 11 17 9739 dated Jan. 18, 2012.

* cited by examiner

*Primary Examiner* — John Hardee
(74) *Attorney, Agent, or Firm* — Greenberg Traurig, LLP

(57) ABSTRACT

An aqueous fabric conditioner composition comprising (a) from 2 to 9 wt % of a fabric softening active, by weight of the total composition, wherein the fabric softening active is an ester-linked quaternary ammonium compound having fatty acid chains comprising from 20 to 35 wt % of saturated C18 chains and from 20 to 35 wt % of monounsaturated C18 chains, by weight of total fatty acid chains; and (b) from 0.01 to 0.5 wt %, by weight of the total composition, of a floc prevention agent, which is a non-ionic alkoxylated material having an HLB value of from 8 to 18, wherein the aqueous fabric conditioner composition has a viscosity of greater than 50 cps, preferably from 55 to 200 cps as measured on a cup and bob viscometer; the viscosity being continuously measured under shear at 106 s"1 for 60 seconds, at 25° C. and wherein the composition leads to little or no floc formation upon addition to water.

13 Claims, No Drawings

FABRIC CONDITIONERS

TECHNICAL FIELD

The present invention relates to dilute fabric conditioner compositions containing unsaturated TEA quaternary ammonium compounds which have a superior thickness and which do not suffer from flocculation during use.

BACKGROUND AND PRIOR ART

The rheological properties of liquid fabric softener formulations are critical for consumer acceptance. A common method of enhancing product appeal and conveying a perception of product richness and efficacy is to increase the apparent thickness of the liquid product. The majority of consumers demonstrate a preference for thicker products over thin products.

A number of ways of increasing viscosity of fabric conditioner compositions are known.

One way is to increase the concentration of quaternary softening active. This, however, is expensive and, therefore, often prohibitive for commercial products. Of course, this approach does not provide a solution in the production of dilute fabric conditioners, where the amount of active is typically limited in the region of from about 2 to 9 wt %.

Another method of increasing viscosity is to add a polymer thickener. There are, however, negative attributes associated with many polymeric thickeners in that they are often non-biodegradable, their addition to the rinse product is technically difficult and such polymer thickened products tend to separate with time and cause redeposition problems.

Also known is to blend the active with fatty alcohol, which increases the product viscosity but leads to poor manufacturing robustness and variability problems.

A further problem that must be considered by the manufacturer of dilute fabric conditioners is the phenomenon of flocculation when fabric conditioner compositions are added to water during a rinse step of a laundry process. "Flocs" are white insoluble precipitates which are visually unacceptable and which reduce the performance of the product. There are several approaches to reducing or eliminating this problem.

It is known, for example, to increase the processing temperature during manufacture of the fabric conditioner in order to reduce the occurrence of flocculation upon use. However, this also reduces the viscosity of the formulation.

Decreasing the amount of fatty alcohol in the fabric conditioner composition can also reduce the level of flocculation but again only at the expense of product viscosity.

The use of milling, during manufacture, is also known to reduce flocculation and viscosity.

The addition of non-ionic materials such as non-ionic surfactants is known to break up flocs but is also well known to reduce viscosity.

US2003/0220217 (Unilever) discloses fabric conditioner compositions comprising a cationic softening agent and a defined silicone material to reduce the drying time of laundered fabrics and/or to increase the rate of water removed from the fabrics during the spin cycle of an automatic washing machine. Nonionic surfactants are preferred adjuncts for the purpose of stabilising the compositions. Fully hardened softening agents are preferred and exemplified.

WO99/50378 (Unilever) discloses fabric softening compositions comprising from 1 to 8 wt % of one or more quaternary ammonium fabric conditioning compounds, a stabilising agent selected from a non-ionic surfactant or a single long chain alkyl cationic surfactant or mixtures thereof and a fatty alcohol. The fatty alcohol increases the stability of the compositions.

US2008/0176784 (Unilever) discloses fabric conditioner compositions in the form of an aqueous dispersion comprising an ester linked quaternary ammonium fabric softening material and an alkoxylated non-ionic material to improve high temperature storage stability.

We have now surprisingly found that the combination of a specific quaternary active with a flocculation prevention agent, which is a non-ionic surfactant, enables the formation of a thick "dilute" fabric conditioner composition, which does not flocculate upon use. The quaternary softening active has a specific distribution of fatty acids having chains of a defined carbon chain length. The flocculation prevention agent is essential to prevent the formation of flocs when the composition is added to water. Surprisingly, the viscosity of the composition is not compromised. This combination of exceptional viscosity and visual attributes in a dilute fabric conditioner has not been achieved before.

STATEMENT OF THE INVENTION

In a first aspect of the invention there is provided a thick, dilute aqueous fabric conditioner composition comprising (a) from 2 to 9 wt % of a fabric softening active, by weight of the total composition, wherein the fabric softening active is an ester-linked quaternary ammonium compound having fatty acid chains comprising from 20 to 35 wt % of saturated C18 chains and from 20 to 35 wt % of monounsaturated C18 chains, by weight of total fatty acid chains; and (b) from 0.01 to 0.5 wt %, by weight of the total composition, of a floc prevention agent, which is a non-ionic alkoxylated material having an HLB value of from 8 to 18, wherein the aqueous fabric conditioner composition has a viscosity of greater than 50 cps, preferably from 55 to 200 cps as measured on a cup and bob viscometer; the viscosity being continuously measured under shear at 106 $s^{-1}$ for 60 seconds, at 25° C. and wherein the composition leads to little or no floc formation upon addition to water.

In a second aspect of the invention there is provided a method of preparing a rinse water, which comprises adding to water a composition as defined in the first aspect.

In a third aspect of the invention, there is provided a use of a composition as defined by the first aspect of the invention, to provide a reduced floc rinse water for the rinsing of fabric.

DETAILED DESCRIPTION OF THE INVENTION

The aqueous fabric conditioner composition of the invention has a viscosity of greater than 50 cps, preferably from 55 to 200 cps, more preferably from 60 to 175, even more preferably from 80 to 150 and most preferably from 100 to 140 cps as measured on a "cup and bob" viscometer; the viscosity being continuously measured under shear at 106 $s^{-1}$ for 60 seconds, at 25° C. Any suitable viscometer can be used, for example, the Haake VT550 with a MV1 cup and bob geometry and the Thermo Fisher RS600 viscometer.

The compositions of the invention do not cause significant flocculation when added to water, such as during a rinse step of a laundry process. Little or no floc formation occurs upon addition of the composition to water. The level of floc formation is reduced compared to the level of floc formation caused by the addition to water of an equivalent composition that does not comprise a floc reducing agent in accordance with the invention.

The Fabric Softening Active

The fabric softening active, for use in the fabric conditioner compositions of the present invention is an ester-linked quaternary ammonium compound (QAC). The fatty acid chains of the QAC comprise from 20 to 35 wt % of saturated C18 chains and from 20 to 35 wt % of monounsaturated C18 chains by weight of total fatty acid chains.

Preferably, the QAC is derived from palm or tallow feedstocks. These feedstocks may be pure or predominantly palm or tallow based. Blends of different feedstocks may be used.

In a preferred embodiment, the fatty acid chains of the QAC comprise from 25 to 30 wt %, preferably from 26 to 28 wt % of saturated C18 chains and from 25 to 30 wt %, preferably from 26 to 28 wt % of monounsaturated C18 chains, by weight of total fatty acid chains.

In a further preferred embodiment, the fatty acid chains of the QAC comprise from 30 to 35 wt %, preferably from 33 to 35 wt % of saturated C18 chains and from 24 to 35 wt %, preferably from 27 to 32 wt % of monounsaturated C18 chains, by weight of total fatty acid chains.

The fabric softening active, for use in the fabric conditioner compositions of the present invention is preferably an ester-linked triethanolamine (TEA) based quaternary ammonium compound.

Ester-linked triethanolamine quaternary ammonium compounds comprise a mixture of mono-, di- and tri-ester linked components. The triester content is preferably below 10 wt %, more preferably from 5 to 9 wt % by total weight of the quaternary active component. Preferred ester-linked triethanolamine quaternary ammonium compounds have a diester content of from 50 to 60 wt %, more preferably from 52 to 59 wt % by total weight of the quaternary active component. Also preferred are TEA quats having a monoester content of from 30 to 45 wt %, more preferably from 32 to 42 wt % by total weight of the quaternary active component.

A preferred TEA quat of the present invention comprises from 32 to 42 wt % of monoester, from 52 to 59 wt % of diester and from 5 to 9 wt % of triester compounds, by total weight of the quaternary active; more preferably from 35 to 39 wt % of monoester, from 54 to 58 wt % of diester and from 7 to 8 wt % of triester compounds, by total weight of the quaternary active component.

The quaternary ammonium materials for use in the compositions are known as "soft" materials. Iodine value as used in the context of the present invention refers to the measurement of the degree of unsaturation present in a material by a method of nmr spectroscopy as described in Anal. Chem., 34, 1136 (1962) Johnson and Shoolery. The preferred quaternary ammonium materials for use in the present invention can be derived from feedstock having an overall iodine value of from 30 to 45, preferably from 30 to 42 and most preferably 36.

Quaternary ammonium compounds (QACs) suitable for use in the present invention can be represented by formula (I)

$$R^1-\overset{[(CH_2)_n(TR)]_m}{\overset{|}{N^+}}-[(CH_2)_n(OH)]_{3-m}X^- \quad (I)$$

wherein, each R is independently selected from a $C_{5-35}$ alkyl or alkenyl group and is selected to result in from 20 to 35 wt % of saturated C18 chains and from 20 to 35 wt % of monounsaturated C18 chains, by weight of total fatty acid chains;

$R^1$ represents a $C_{1-4}$ alkyl, $C_{2-4}$ alkenyl or a $C_{1-4}$ hydroxyalkyl group;

T is generally O—CO (i.e. an ester group bound to R via its carbon atom), but may alternatively be CO—O (i.e. an ester group bound to R via its oxygen atom);

n is a number selected from 1 to 4;

m is a number selected from 1, 2, or 3; and $X^-$ is an anionic counter-ion, preferably a halide or alkyl sulphate, e.g. chloride or methylsulphate.

Preferred quaternary ammonium actives according to Formula I are available, for example, TEP-88L available from FXG (Feixiang Chemicals (Zhangjiagang) Co., Ltd., China; Stepantex SP88-2 and Stepantex VT-90 ex Stepan; Tetranyl L1/90N ex Kao, Rewoquat V10058 ex Evonik and Prapegen TQN ex Clariant.

A second group of QACs suitable for use in the invention is represented by Formula (II):

$$(R^1)_2-N^+-[(CH_2)_n\text{-}T\text{-}R^2]_2X^- \quad (II)$$

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above.

Preferred materials of this second group include bis(2-tallowoyloxyethyl)dimethyl ammonium chloride.

The fabric conditioning compositions of the invention are "dilute" and comprise from 2 to 9 wt %, preferably from 3 to 8 wt %, most preferably from 3 to 5 wt %, of a fabric softening active, by weight of the total composition.

The Floc Prevention Agent

The compositions of the invention comprise a floc prevention agent, which is a non-ionic alkoxylated material having an HLB value of from 8 to 18, preferably from 11 to 16, more preferably from 12 to 16 and most preferably 16.

The non-ionic alkoxylated material can be linear or branched, preferably linear.

The floc prevention agent is present in an amount of from 0.01 to 0.5 wt %, preferably from 0.02 to 0.4 wt %, more preferably from 0.05 to 0.25 wt % and most preferably 0.1 wt % by total weight of the composition.

Suitable floc prevention agents include nonionic surfactants. Suitable non-ionic surfactants include addition products of ethylene oxide and/or propylene oxide with fatty alcohols, fatty acids and fatty amines. The floc prevention agent is preferably selected from addition products of (a) an alkoxide selected from ethylene oxide, propylene oxide and mixtures thereof with (b) a fatty material selected from fatty alcohols, fatty acids and fatty amines.

Suitable surfactants are substantially water soluble surfactants of the general formula:

$$R-Y-(C_2H_4O)_z-CH_2-CH_2-OH$$

where R is selected from the group consisting of primary, secondary and branched chain alkyl and/or acyl hydrocarbyl groups (when Y=—C(O)O, R≠an acyl hydrocarbyl group); primary, secondary and branched chain alkenyl hydrocarbyl groups; and primary, secondary and branched chain alkenyl-substituted phenolic hydrocarbyl groups; the hydrocarbyl groups having a chain length of from 10 to 60, preferably 10 to 25, e.g. 14 to 20 carbon atoms.

In the general formula for the ethoxylated nonionic surfactant, Y is typically:

—O—, —C(O)O—, —C(O)N(R)— or —C(O)N(R)R— in which R has the meaning given above or can be hydrogen; and Z is at least about 6, preferably at least about 10 or 11.

Lutensol™ AT25 (BASF) based on coco chain and 25 EO groups is an example of a suitable nonoionic surfactant. Other suitable surfactants include Renex 36 (Trideceth-6), ex Uniqema; Tergitol 15-S3, ex Dow Chemical Co.; Dihydrol LT7, ex That Ethoxylate ltd; Cremophor CO40, ex BASF and Neodol 91-8, ex Shell.

The Polymeric Thickening Agent

Thickening polymers may be added to the compositions of the invention for further thickening. Any suitable thickener polymer may be used.

Suitable polymers are water soluble or dispersable. A high M·Wt, (for example, in the region of about 100,000 to 5,000,000) which can be achieved by crosslinking, is advantageous. Preferably, the polymer is cationic.

Polymers particularly useful in the compositions of the invention include those described in WO2010/078959 (SNF S.A.S.). These are crosslinked water swellable cationic copolymers having at least one cationic monomer and optionally other non-ionic and/or anionic monomers. Preferred polymers of this type are copolymers of acrylamide and trimethylaminoethylacrylate chloride.

Preferred polymers comprise less than 25% of water soluble polymers by weight of the total polymer, preferably less than 20%, and most preferably less than 15%, and a cross-linking agent concentration of from 500 ppm to 5000 ppm relative to the polymer, preferably from 750 ppm to 5000 ppm, more preferably from 1000 to 4500 ppm (as determined by a suitable metering method such as that described on page 8 of patent EP 343840). The cross-linking agent concentration must be higher than about 500 ppm relative to the polymer, and preferably higher than about 750 ppm when the crosslinking agent used is the methylene bisacrylamide, or other cross-linking agents at concentrations that lead to equivalent cross-linking levels of from 10 to 10,000 ppm.

Suitable cationic monomers are selected from the group consisting of the following monomers and derivatives and their quaternary or acid salts: dimethylaminopropylmethacrylamide, dimethylaminopropylacrylamide, diallylamine, methyldiallylamine, dialkylaminoalkyl-acrylates and methacrylates, dialkylaminoalkyl-acrylamides or -methacrylamides.

Following is a non-restrictive list of monomers performing a non-ionic function: acrylamide, methacrylamide, N-Alkyl acrylamide, N-vinyl pyrrolidone, N-vinyl formamide, N-vinyl acetamide, vinylacetate, vinyl alcohol, acrylate esters, allyl alcohol.

Following is a non-restrictive list of monomers performing an anionic function: acrylic acid, methacrylic acid, itaconic acid, crotonic acid, maleic acid, fumaric acid, as well as monomers performing a sulfonic acid or phosphonic acid functions, such as 2-acrylamido-2-methyl propane sulfonic acid (ATBS) etc. The monomers may also contain hydrophobic groups.

Following is a non-restrictive list of cross-linking agents: methylene bisacrylamide (MBA), ethylene glycol diacrylate, polyethylene glycol dimethacrylate, diacrylamide, triallylamine, cyanomethylacrylate, vinyl oxyethylacrylate or methacrylate and formaldehyde, glyoxal, compounds of the glycidyl ether type such as ethyleneglycol diglycidyl ether, or the epoxydes or any other means familiar to the expert permitting cross-linking.

By way of preeminent preference the cross-linking rate preferably ranges from 800 to 5000 ppm (on the basis of methylene bisacrylamide) relative to the polymer or equivalent cross-linking with a cross-linking agent of different efficiency.

As described in US 2002/0132749 and Research Disclosure 429116, the degree of non-linearity can additionally be controlled by the inclusion of chain transfer agents (such as isopropyl alcohol, sodium hypophosphite, mercaptoethanol) in the polymerisation mixture in order to control the polymeric chain's length and the cross-linking density.

The amount of polymer used in the compositions of the invention is suitably from 0.001 to 0.5 wt %, preferably from 0.005 to 0.4 wt %, more preferably from 0.05 to 0.35 wt % and most preferably from 0.1 to 0.25 wt %, by weight of the total composition.

An example of a preferred polymer is Flosoft 270LS ex SNF.

Further Optional Ingredients

Non-Ionic Softener

The compositions of the invention may contain a non-cationic softening material, which is preferably an oily sugar derivative. An oily sugar derivative is a liquid or soft solid derivative of a cyclic polyol (CPE) or of a reduced saccharide (RSE), said derivative resulting from 35 to 100% of the hydroxyl groups in said polyol or in said saccharide being esterified or etherified. The derivative has two or more ester or ether groups independently attached to a $C_8$-$C_{22}$ alkyl or alkenyl chain.

Advantageously, the CPE or RSE does not have any substantial crystalline character at 20° C. Instead it is preferably in a liquid or soft solid state as herein defined at 20° C.

The liquid or soft solid (as hereinafter defined) CPEs or RSEs suitable for use in the present invention result from 35 to 100% of the hydroxyl groups of the starting cyclic polyol or reduced saccharide being esterified or etherified with groups such that the CPEs or RSEs are in the required liquid or soft solid state. These groups typically contain unsaturation, branching or mixed chain lengths.

Typically the CPEs or RSEs have 3 or more ester or ether groups or mixtures thereof, for example 3 to 8, especially 3 to 5. It is preferred if two or more of the ester or ether groups of the CPE or RSE are independently of one another attached to a $C_8$ to $C_{22}$ alkyl or alkenyl chain. The $C_8$ to $C_{22}$ alkyl or alkenyl groups may be branched or linear carbon chains.

Preferably 35 to 85% of the hydroxyl groups, most preferably 40-80%, even more preferably 45-75%, such as 45-70% are esterified or etherified.

Preferably the CPE or RSE contains at least 35% tri or higher esters, e.g. at least 40%.

The CPE or RSE has at least one of the chains independently attached to the ester or ether groups having at least one unsaturated bond. This provides a cost effective way of making the CPE or RSE a liquid or a soft solid. It is preferred if predominantly unsaturated fatty chains, derived from, for example, rape oil, cotton seed oil, soybean oil, oleic, tallow, palmitoleic, linoleic, erucic or other sources of unsaturated vegetable fatty acids, are attached to the ester/ether groups.

These chains are referred to below as the ester or ether chains (of the CPE or RSE).

The ester or ether chains of the CPE or RSE are preferably predominantly unsaturated. Preferred CPEs or RSEs include sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose tiroleate, glucose tetraoleate, xylose trioleate, or sucrose tetra-, tri-, penta- or hexa-esters with any mixture of predominantly unsaturated fatty acid chains. The most preferred CPEs or RSEs are those with monosaturated fatty acid chains, i.e. where any polyunsaturation has been removed by partial hydrogenation. However some CPEs or RSEs based on polyunsaturated fatty acid chains, e.g. sucrose tetralinoleate, may be used provided most of the polyunsaturation has been removed by partial hydrogenation.

The most highly preferred liquid CPEs or RSEs are any of the above but where the polyunsaturation has been removed through partial hydrogenation.

Preferably 40% or more of the fatty acid chains contain an unsaturated bond, more preferably 50% or more, most preferably 60% or more. In most cases 65% to 100%, e.g. 65% to 95% contain an unsaturated bond.

CPEs are preferred for use with the present invention. Inositol is a preferred example of a cyclic polyol. Inositol derivatives are especially preferred.

In the context of the present invention, the term cyclic polyol encompasses all forms of saccharides. Indeed saccharides are especially preferred for use with this invention. Examples of preferred saccharides for the CPEs or RSEs to be derived from are monosaccharides and disaccharides.

Examples of monosaccharides include xylose, arabinose, galactose, fructose, sorbose and glucose. Glucose is especially preferred. Examples of disaccharides include maltose, lactose, cellobiose and sucrose. Sucrose is especially preferred. An example of a reduced saccharide is sorbitan.

The liquid or soft solid CPEs can be prepared by methods well known to those skilled in the art. These include acylation of the cyclic polyol or reduced saccharide with an acid chloride; trans-esterification of the cyclic polyol or reduced saccharide fatty acid esters using a variety of catalysts; acylation of the cyclic polyol or reduced saccharide with an acid anhydride and acylation of the cyclic polyol or reduced saccharide with a fatty acid. See for instance U.S. Pat. No. 4,386,213 and AU 14416/88 (both P&G).

It is preferred if the CPE or RSE has 3 or more, preferably 4 or more ester or ether groups. If the CPE is a disaccharide it is preferred if the disaccharide has 3 or more ester or ether groups. Particularly preferred CPEs are esters with a degree of esterification of 3 to 5, for example, sucrose tri, tetra and penta esters.

Where the cyclic polyol is a reducing sugar it is advantageous if each ring of the CPE has one ether or ester group, preferably at the $C_1$ position. Suitable examples of such compounds include methyl glucose derivatives.

Examples of suitable CPEs include esters of alkyl(poly) glucosides, in particular alkyl glucoside esters having a degree of polymerisation from 1 to 2.

The length of the unsaturated (and saturated if present) chains in the CPE or RSE is $C_8$-$C_{22}$, preferably $C_{12}$-$C_{22}$. It is possible to include one or more chains of $C_1$-$C_8$, however these are less preferred.

The liquid or soft solid CPEs or RSEs which are suitable for use in the present invention are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the signal with a $T_2$ of less than 100 μs is considered to be a solid component and any component with $T_2 \geq 100$ μs is considered to be a liquid component.

For the CPEs and RSEs, the prefixes (e.g. tetra and penta) only indicate the average degrees of esterification. The compounds exist as a mixture of materials ranging from the monoester to the fully esterified ester. It is the average degree of esterification which is used herein to define the CPEs and RSEs.

The HLB of the CPE or RSE is typically between 1 and 3.

Where present, the CPE or RSE is preferably present in the composition in an amount of 0.5-50% by weight, based upon the total weight of the composition, more preferably 1-30% by weight, such as 2-25%, e.g. 2-20%.

The CPEs and RSEs for use in the compositions of the invention include sucrose tetraoleate, sucrose pentaerucate, sucrose tetraerucate and sucrose pentaoleate.

Shading Dyes

Optional shading dyes can be used. Preferred dyes are violet or blue. Suitable and preferred classes of dyes are discussed below. Moreover the unsaturated quaternary ammonium compounds are subject to some degree of UV light and/or transition metal ion catalysed radical auto-oxidation, with an attendant risk of yellowing of fabric. The present of a shading dye also reduces the risk of yellowing from this source.

Different shading dyes give different levels of colouring. The level of shading dye present in the compositions of the present invention depend, therefore, on the type of shading dye. Preferred overall ranges, suitable for the present invention are from 0.00001 to 0.1 wt %, more preferably 0.0001 to 0.01 wt %, most preferably 0.0005 to 0.005 wt % by weight of the total composition.

Direct Dyes

Direct dyes (otherwise known as substantive dyes) are the class of water soluble dyes which have an affinity for fibres and are taken up directly. Direct violet and direct blue dyes are preferred.

Preferably the dye are bis-azo or tris-azo dyes are used.

Most preferably, the direct dye is a direct violet of the following structures:

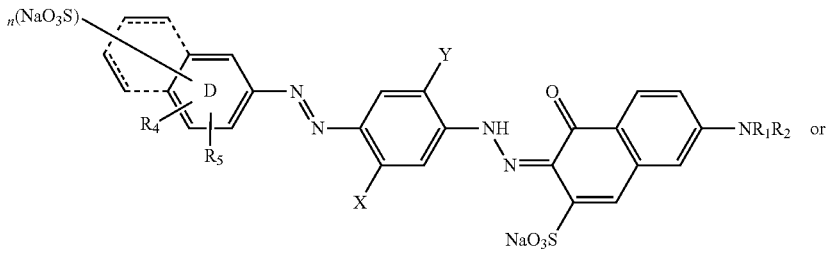

-continued

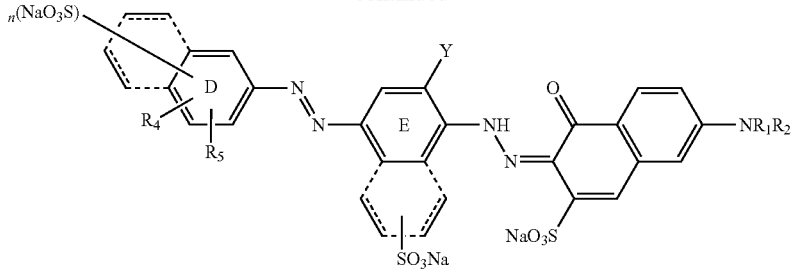

wherein:

ring D and E may be independently naphthyl or phenyl as shown;

$R_1$ is selected from: hydrogen and C1-C4-alkyl, preferably hydrogen;

$R_2$ is selected from: hydrogen, C1-C4-alkyl, substituted or unsubstituted phenyl and substituted or unsubstituted naphthyl, preferably phenyl;

$R_3$ and $R_4$ are independently selected from: hydrogen and C1-C4-alkyl, preferably hydrogen or methyl;

X and Y are independently selected from: hydrogen, C1-C4-alkyl and C1-C4-alkoxy; preferably the dye has X=methyl; and, Y=methoxy and n is 0, 1 or 2, preferably 1 or 2.

Preferred dyes are direct violet 7, direct violet 9, direct violet 11, direct violet 26, direct violet 31, direct violet 35, direct violet 40, direct violet 41, direct violet 51, and direct violet 99. Bis-azo copper containing dyes such as direct violet 66 may be used. The benzidene based dyes are less preferred.

Preferably the direct dye is present at 0.00001 wt % to 0.0010 wt % of the formulation.

In another embodiment the direct dye may be covalently linked to the photo-bleach, for example as described in WO2006/024612.

Acid Dyes

Cotton substantive acid dyes give benefits to cotton containing garments.

Preferred dyes and mixes of dyes are blue or violet. Preferred acid dyes are:

(i) azine dyes, wherein the dye is of the following core structure:

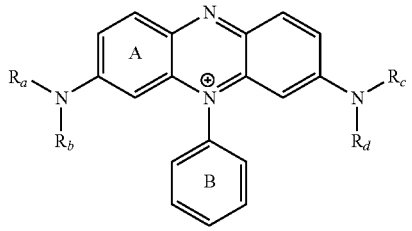

wherein $R_a$, $R_b$, $R_c$ and $R_d$ are selected from: H, an branched or linear C1 to C7-alkyl chain, benzyl a phenyl, and a naphthyl;

the dye is substituted with at least one $SO_3^-$ or —$COO^-$ group;

the B ring does not carry a negatively charged group or salt thereof;

and the A ring may further substituted to form a naphthyl;

the dye is optionally substituted by groups selected from: amine, methyl, ethyl, hydroxyl, methoxy, ethoxy, phenoxy, Cl, Br, I, F, and $NO_2$.

Preferred azine dyes are: acid blue 98, acid violet 50, and acid blue 59, more preferably acid violet 50 and acid blue 98.

Other preferred non-azine acid dyes are acid violet 17, acid black 1 and acid blue 29.

Preferably the acid dye is present at 0.0005 wt % to 0.01 wt % of the formulation.

Hydrophobic Dyes

The composition may comprise one or more hydrophobic dyes selected from benzodifuranes, methine, triphenylmethanes, napthalimides, pyrazole, napthoquinone, anthraquinone and mono-azo or di-azo dye chromophores. Hydrophobic dyes are dyes which do not contain any charged water solubilising group. Hydrophobic dyes may be selected from the groups of disperse and solvent dyes. Blue and violet anthraquinone and mono-azo dye are preferred.

Preferred dyes include solvent violet 13, disperse violet 27 disperse violet 26, disperse violet 28, disperse violet 63 and disperse violet 77.

Preferably, where present, the hydrophobic dye is present at 0.0001 wt % to 0.005 wt % of the formulation.

Basic Dyes

Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International.

Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141.

Reactive Dyes

Reactive dyes are dyes which contain an organic group capable of reacting with cellulose and linking the dye to cellulose with a covalent bond. They deposit onto cotton.

Preferably the reactive group is hydrolysed or reactive group of the dyes has been reacted with an organic species such as a polymer, so as to the link the dye to this species. Dyes may be selected from the reactive violet and reactive blue dyes listed in the Colour Index International.

Preferred examples include reactive blue 19, reactive blue 163, reactive blue 182 and reactive blue, reactive blue 96.

Dye Conjugates

Dye conjugates are formed by binding direct, acid or basic dyes to polymers or particles via physical forces.

Dependent on the choice of polymer or particle they deposit on cotton or synthetics. A description is given in WO2006/055787. They are not preferred.

Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof.

Perfume

The compositions of the present invention may comprise one or more perfumes if desired. The perfume is preferably present in an amount from 0.01 to 10% by weight, more preferably from 0.05 to 5% by weight, even more preferably from 0.05 to 2%, most preferably from 0.05 to 1.5% by weight, based on the total weight of the composition.

Useful components of the perfume include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products, i.e., of imparting an odour and/or a flavour or taste to a consumer product traditionally perfumed or flavoured, or of modifying the odour and/or taste of said consumer product.

By perfume in this context is not only meant a fully formulated product fragrance, but also selected components of that fragrance, particularly those which are prone to loss, such as the so-called 'top notes'.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol. Top notes typically comprise 15-25% wt of a perfume composition and in those embodiments of the invention which contain an increased level of top-notes it is envisaged at that least 20% wt would be present within the encapsulate.

Some or all of the perfume or pro-fragrance may be encapsulated, typical perfume components which it is advantageous to encapsulate, include those with a relatively low boiling point, preferably those with a boiling point of less than 300, preferably 100-250 Celsius and pro-fragrances which can produce such components.

It is also advantageous to encapsulate perfume components which have a low C log P (i.e. those which will be partitioned into water), preferably with a C log P of less than 3.0. These materials, of relatively low boiling point and relatively low C log P have been called the "delayed blooming" perfume ingredients and include the following materials:

Allyl Caproate, Amyl Acetate, Amyl Propionate, Anisic Aldehyde, Anisole, Benzaldehyde, Benzyl Acetate, Benzyl Acetone, Benzyl Alcohol, Benzyl Formate, Benzyl Iso Valerate, Benzyl Propionate, Beta Gamma Hexenol, Camphor Gum, Laevo-Carvone, d-Carvone, Cinnamic Alcohol, Cinamyl Formate, Cis-Jasmone, cis-3-Hexenyl Acetate, Cuminic Alcohol, Cyclal C, Dimethyl Benzyl Carbinol, Dimethyl Benzyl Carbinol Acetate, Ethyl Acetate, Ethyl Aceto Acetate, Ethyl Amyl Ketone, Ethyl Benzoate, Ethyl Butyrate, Ethyl Hexyl Ketone, Ethyl Phenyl Acetate, Eucalyptol, Eugenol, Fenchyl Acetate, Flor Acetate (tricyclo Decenyl Acetate), Frutene (tricycico Decenyl Propionate), Geraniol, Hexenol, Hexenyl Acetate, Hexyl Acetate, Hexyl Formate, Hydratropic Alcohol, Hydroxycitronellal, Indone, Isoamyl Alcohol, Iso Menthone, Isopulegyl Acetate, Isoquinolone, Ligustral, Linalool, Linalool Oxide, Linalyl Formate, Menthone, Menthyl Acetphenone, Methyl Amyl Ketone, Methyl Anthranilate, Methyl Benzoate, Methyl Benzyl Acetate, Methyl Eugenol, Methyl Heptenone, Methyl Heptine Carbonate, Methyl Heptyl Ketone, Methyl Hexyl Ketone, Methyl Phenyl Carbinyl Acetate, Methyl Salicylate, Methyl-N-Methyl Anthranilate, Nerol, Octalactone, Octyl Alcohol, p-Cresol, p-Cresol Methyl Ether, p-Methoxy Acetophenone, p-Methyl Acetophenone, Phenoxy Ethanol, Phenyl Acetaldehyde, Phenyl Ethyl Acetate, Phenyl Ethyl Alcohol, Phenyl Ethyl Dimethyl Carbinol, Prenyl Acetate, Propyl Bornate, Pulegone, Rose Oxide, Safrole, 4-Terpinenol, Alpha-Terpinenol, and/or Viridine.

Preferred non-encapsulated perfume ingredients are those hydrophobic perfume components with a C log P above 3. As used herein, the term "C log P" means the calculated logarithm to base 10 of the octanol/water partition coefficient (P). The octanol/water partition coefficient of a PRM is the ratio between its equilibrium concentrations in octanol and water. Given that this measure is a ratio of the equilibrium concentration of a PRM in a non-polar solvent (octanol) with its concentration in a polar solvent (water), C log P is also a measure of the hydrophobicity of a material—the higher the C log P value, the more hydrophobic the material. C log P values can be readily calculated from a program called "C LOG P" which is available from Daylight Chemical Information Systems Inc., Irvine Calif., USA. Octanol/water partition coefficients are described in more detail in U.S. Pat. No. 5,578,563.

Perfume components with a C log P above 3 comprise: Iso E super, citronellol, Ethyl cinnamate, Bangalol, 2,4,6-Trimethylbenzaldehyde, Hexyl cinnamic aldehyde, 2,6-Dimethyl-2-heptanol, Diisobutylcarbinol, Ethyl salicylate, Phenethyl isobutyrate, Ethyl hexyl ketone, Propyl amyl ketone, Dibutyl ketone, Heptyl methyl ketone, 4,5-Dihydrotoluene, Caprylic aldehyde, Citral, Geranial, Isopropyl benzoate, Cyclohexanepropionic acid, Campholene aldehyde, Caprylic acid, Caprylic alcohol, Cuminaldehyde, 1-Ethyl-4-nitrobenzene, Heptyl formate, 4-Isopropylphenol, 2-Isopropylphenol, 3-Isopropylphenol, Allyl disulfide, 4-Methyl-1-phenyl-2-pentanone, 2-Propylfuran, Allyl caproate, Styrene, Isoeugenyl methyl ether, Indonaphthene, Diethyl suberate, L-Menthone, Menthone racemic, p-Cresyl isobutyrate, Butyl butyrate, Ethyl hexanoate, Propyl valerate, n-Pentyl propanoate, Hexyl acetate, Methyl heptanoate, trans-3,3,5-Trimethylcyclohexanol, 3,3,5-Trimethylcyclohexanol, Ethyl p-anisate, 2-Ethyl-1-hexanol, Benzyl isobutyrate, 2,5-Dimethylthiophene, Isobutyl 2-butenoate, Caprylnitrile, gamma-Nonalactone, Nerol, trans-Geraniol, 1-Vinylheptanol, Eucalyptol, 4-Terpinenol, Dihydrocarveol, Ethyl 2-methoxybenzoate, Ethyl cyclohexanecarboxylate, 2-Ethylhexanal, Ethyl amyl carbinol, 2-Octanol, 2-Octanol, Ethyl methylphenylglycidate, Diisobutyl ketone, Coumarone, Propyl isovalerate, Isobutyl butanoate, Isopentyl propanoate, 2-Ethylbutyl acetate, 6-Methyl-tetrahydroquinoline, Eugenyl methyl ether, Ethyl dihydrocinnamate, 3,5-Dimethoxytoluene, Toluene, Ethyl benzoate, n-Butyrophenone, alpha-Terpineol, Methyl 2-methylbenzoate, Methyl 4-methylbenzoate, Methyl 3, methylbenzoate, sec. Butyl n-butyrate, 1,4-Cineole, Fenchyl alcohol, Pinanol, cis-2-Pinanol, 2,4, Dimethylacetophenone, Isoeugenol, Safrole, Methyl 2-octynoate, o-Methylanisole, p-Cresyl methyl ether, Ethyl anthranilate, Linalool, Phenyl butyrate, Ethylene glycol dibutyrate, Diethyl phthalate, Phenyl mercaptan, Cumic alcohol, m-Toluquinoline, 6-Methylquinoline, Lepidine, 2-Ethylbenzaldehyde, 4-Ethylbenzaldehyde, o-Ethylphenol, p-Ethylphenol, m-Ethylphenol, (+)-Pulegone, 2,4-Dimethylbenzaldehyde, Isoxylaldehyde, Ethyl sorbate, Benzyl propionate, 1,3-Dimethylbutyl acetate, Isobutyl isobutanoate, 2,6-Xylenol, 2,4-Xylenol, 2,5-Xylenol, 3,5-Xylenol, Methyl cinnamate, Hexyl methyl ether, Benzyl ethyl ether, Methyl salicylate, Butyl propyl ketone, Ethyl amyl ketone, Hexyl methyl ketone, 2,3-Xylenol, 3,4, Xylenol, Cyclopentadenanolide and Phenyl ethyl 2 phenylacetate 2.

It is commonplace for a plurality of perfume components to be present in a formulation. In the compositions of the present invention it is envisaged that there will be four or more, preferably five or more, more preferably six or more or even seven or more different perfume components from the list given of delayed blooming perfumes given above and/or the list of perfume components with a C log P above 3 present in the perfume.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian.

Co-Softeners and Fatty Complexing Agents

Co-softeners may be used. Suitable co-softeners include fatty acids. When employed, they are typically present at from 0.1 to 20% and particularly at from 0.5 to 10%, based on the total weight of the composition. Preferred co-softeners include fatty esters, and fatty N-oxides. Fatty esters that may be employed include fatty monoesters, such as glycerol monostearate, fatty sugar esters, such as those disclosed WO 01/46361 (Unilever).

Preferred fatty acids include hardened tallow fatty acid (available under the tradename Pristerene™, ex Uniqema). Preferred fatty alcohols include hardened tallow alcohol (available under the tradenames Stenol™ and Hydrenol™, ex Cognis and Laurex™ CS, ex Albright and Wilson).

The compositions for use in the present invention may comprise a fatty complexing agent.

Especially suitable fatty complexing agents include fatty alcohols.

Fatty complexing material may be used to improve the viscosity profile of the composition.

The fatty complexing agent is preferably present in an amount greater than 0.3 to 5% by weight based on the total weight of the composition. More preferably, the fatty component is present in an amount of from 0.4 to 4%. The weight ratio of the mono-ester component of the quaternary ammonium fabric softening material to the fatty complexing agent is preferably from 5:1 to 1:5, more preferably 4:1 to 1:4, most preferably 3:1 to 1:3, e.g. 2:1 to 1:2.

Further Optional Ingredients

The compositions of the invention may contain one or more other ingredients. Such ingredients include further preservatives (e.g. bactericides), pH buffering agents, perfume carriers, hydrotropes, anti-redeposition agents, soil-release agents, polyelectrolytes, anti-shrinking agents, anti-wrinkle agents, anti-oxidants, sunscreens, anti-corrosion agents, drape imparting agents, anti-static agents, ironing aids pearlisers and/or opacifiers, natural oils/extracts, processing aids, e.g. electrolytes, hygiene agents, e.g. anti-bacterials and anti-fungals and skin benefit agents.

Product Form

The compositions of the present invention are aqueous fabric conditioning compositions suitable for use in a laundry process. Preferably, the compositions comprise at least 75 wt % water, more preferably from 80 to 97 wt % water and most preferably from 90 to 96 wt % water, by weight of the total composition.

The compositions of the invention may also contain pH modifiers such as hydrochloric acid or lactic acid. The liquid compositions preferably have a pH of about 2.5 to 3.0.

The composition is preferably for use in the rinse cycle of a home textile laundering operation, where, it may be added directly in an undiluted state to a washing machine, e.g. through a dispenser drawer or, for a top-loading washing machine, directly into the drum. The compositions may also be used in a domestic hand-washing laundry operation.

It is also possible for the compositions of the present invention to be used in industrial laundry operations, e.g. as a finishing agent for softening new clothes prior to sale to consumers.

Preparation of the Compositions of the Invention

The compositions of the invention may be made by combining a melt comprising the fabric softening active with an aqueous phase.

A preferred method of preparation for a dilute is as follows:—

1. Heat water to about 40 to 50° C.
2. Add the non-ionic floc prevention agent to the water.
3. Add the polymer to the water with stirring and mix thoroughly.
4. Add any minor ingredients, such as antifoams, acid, sequestrants and preservatives.
5. Melt the softening active and any co-active together to form a co-melt.
6. Add the co-melt to the heated water phase.
7. Add dyes and perfumes.
8. Cool.

In a further preferred method of preparation, the nonionic floc prevention agent can be added with the perfume. Alternatively, it may be added at the end of the process after cooling.

EXAMPLES

Embodiments of the invention will now be illustrated by the following non-limiting examples. Further modifications will be apparent to the person skilled in the art.

Examples of the invention are represented by a number. Comparative examples are represented by a letter.

Unless otherwise stated, amounts of components are expressed as a percentage of the total weight of the composition.

The Softening Active

Two ester-linked quaternary compounds were used to prepare fabric softener compositions. Both are palm-based soft TEA quaternary ammonium compounds.

1) TEAQ1, (Stepantex SP88 ex Stepan).

2) TEAQ 2, (TEP-88L ex FXG (Feixiang Chemicals (Zhangjiagang) Co. Ltd., China).

The ester distribution of the fatty acid chains (mono-, di- and tri-ester components) of both of these quaternary materials is given in Table 1:—

TABLE 1

Mono-, di- and tri-ester component distribution of TEAQ1 and TEAQ2

| Sample | Mono | Di | Tri |
|---|---|---|---|
| TEAQ1 | 36.2% | 56.5% | 7.4% |
| TEAQ2 | 35.8% | 57.0% | 7.2% |

The carbon chain length distribution of the fatty acid chains of these quaternary compounds is given below:—

TABLE 2

Fatty acid carbon chain length distribution of TEAQ1 and TEAQ2

| | TEAQ1 | TEAQ2 |
|---|---|---|
| C12 | 0.3 | 0.3 |
| C14 | 1 | 0.6 |
| C16 | 46.3 | 42.3 |
| C16:1 | 0.3 | 0.3 |
| C18 | 12.8 | 26.4 |
| C18:1 | 33.9 | 26.1 |
| C18:2 | 5.3 | 4 |
| C18:3 | <0.1 | <0.1 |

It will be seen that both actives (TEAQ1 and TEAQ2) have similar ester distributions, but crucially, they have different distributions of fatty acid chain lengths. TEAQ2 is in accordance with the definition of the fabric softening active for use in the invention, and TEAQ1 is not.

Example 1

Preparation of Fabric Conditioners 1-6 in Accordance with the Invention and Comparative Examples A to C Compositions 1-6, A to C were dilute liquid fabric conditioners, comprising about 3% of active. The compositions are shown in Table 3.

The compositions shown in Table 3 were prepared using the following method:

1. The water was heated to about 45° C.
2. Non-ionic surfactant was then added to the heated water with stirring.
3. The polymer was then added to the water over about 1 minute with stirring and the mixture was mixed thoroughly.
4. The minor ingredients and acid were then added.
5. The softening active and fatty alcohol (or fatty acid) were melted together to form a co-melt.
6. The co-melt was then added to the heated water.
7. Dyes and perfumes were added.
8. The resultant composition was then cooled.

Example 2

Viscosities and Flocculation Behaviour of Compositions 1-6 and Comparative Examples A to C Note Regarding the Stability of Comparative Example C.

The initial viscosity of C, at a process temp of 45° C. was 63 cps. However, the product suffered gross product separation within 24 hours and therefore, no further characterisation studies were carried out.

Viscosities

Viscosities of the freshly made dilute compositions were measured using a Haake VT550 with a MV1 "cup and bob"

TABLE 3

Compositions of the liquid fabric softeners 1-6, A to C.

| Ingredient (wt %) | A | B | C | 1 | 2 | 3 | 4 | 5 | 6 |
|---|---|---|---|---|---|---|---|---|---|
| TEAQ1[1] | 2.96 | — | — | — | — | — | — | — | — |
| TEAQ2[2] | — | 2.96 | — | 2.96 | 2.96 | 2.96 | 2.96 | 2.96 | 2.96 |
| TEAQ3[3] | — | — | 2.2 | — | — | — | — | — | — |
| Fatty alcohol[4] | 0.49 | 0.49 | — | 0.49 | 0.49 | 0.49 | 0.49 | 0.49 | 0.49 |
| Fatty acid[11] | — | — | 0.38 | — | — | — | — | — | — |
| Perfume carrier[12] | — | — | 3.3 | — | — | — | — | — | — |
| Perfume[9] | 0.16 | 0.16 | 0.3 | 0.16 | 0.16 | 0.16 | 0.16 | 0.16 | 0.16 |
| Polymer[5] | 0.25 | 0.25 | — | 0.25 | 0.25 | 0.25 | 0.25 | 0.25 | 0.25 |
| Dye[6] | 0.0076 | 0.0076 | — | 0.0076 | 0.0076 | 0.0076 | 0.0076 | 0.0076 | 0.0076 |
| HCl | to pH 2.5 | to pH 2.5 | — | to pH 2.5 | to pH 2.5 | to pH 2.5 | to pH 2.5 | to pH 2.5 | to pH 2.5 |
| Glycerol monostearate | — | — | 0.2 | — | — | — | — | — | — |
| Water & minors[7] | to 100 | to 100 | To 100 | to 100 | to 100 | to 100 | to 100 | to 100 | to 100 |
| Lutensol AT25[8] | — | — | — | 0.1 | — | — | — | — | — |
| Renex 36[8] | — | — | — | — | 0.1 | — | — | — | — |
| Cremophor CO40[8] | — | — | — | — | — | 0.1 | — | — | — |
| Dehydrol LT7[8] | — | — | — | — | — | — | 0.1 | — | — |
| Neodol 91-8[8] | — | — | — | — | — | — | — | 0.1 | — |
| Tergitol 15-S-3[10] | — | — | 0.1 | — | — | — | — | — | 0.1 |

[1]Palm based soft TEA Quat; ex Stepan
[2]Palm based soft TEA Quat, ex FXG
[3]Tallow based partially hardened TEA Quat, ex Kao
[4]Ginol 1618AT; ex Godrej;
[5]Flosoft 270LS ex-SNF
[6]Liquitint dyes ex Milliken
[7]Antifoam, preservative, sequestrant (for A, B and 1-6); antifoam, preservative only for C
[8]Nonionic surfactant - flocculation prevention agent
[9]MJ Baccarat, ex IFF for A, B and 1-6; Givaudan fragrance for C
[10]ex Dow
[11]Pristerine 4981
[12]Stemtol 70/28, ex Goldschmit geometry and the viscosity continuously measured under shear at 106 $s^{-1}$ for 60 seconds at 25° C.

Flocculation

The flocculation of fabric conditioner can be evaluated by dispersing a small quantity of fabric conditioner in water of known hardness and visually evaluating the quality of the dispersion formed.

The amount of flocculation is known to be affected by water hardness. In order to take this into account, flocculation behaviour was measured at a range of water hardness environments. This was achieved by varying the hardness (French Hardness; FH) and the chloride:sulphate ratio of the water. The water can be prepared with the desired properties by adding calcium chloride dihydrate and magnesium sulphate heptahydrate to deionised water. Water having a high FH and a low ratio of $Cl^-:SO_4^{2-}$ is most likely to induce flocculation.

Three different test waters were prepared, designated W1, W2 and W3, as detailed in Table 4:—

TABLE 4

Hardness (° FH) and ratio of $Cl^-:SO_4^{2-}$ of test waters W1, W2 and W3

| Test Water | Hardness (° FH) | [a]Ratio of $Cl:SO_4$ |
|---|---|---|
| W1 | 6 | 3:1 |
| W2 | 12 | 2:1 |
| W3 | 24 | 1:1 |

[a]From $CaCl_2$ and $MgSO_4$

Of these, W3 provides the most likely environment to induce flocculation, and W1 the least likely. Of course, a product that shows no flocs under high floc-inducing conditions is unlikely to flocculate under more favourable conditions.

The level of flocculation occurring upon addition of the compositions to water was measured as follows:—

1 ml of product was added to 200 ml water of the desired hardness with stirring and mixed for 30 seconds. The dispersion was then allowed to stand without agitation for 2 minutes before the formation of flocculates was assessed.

The amount of flocculation was assessed on the following 9 point scale:—

| | |
|---|---|
| 0 | No flocs visible, product uniformly dispersed. |
| 0.5 | |
| 1 | Small flocs visible, floccs uniformly distributed. |
| 1.5 | |
| 2 | Small flocs, some clumping |
| 2.5 | |
| 3 | Medium flocs some clumping. |
| 3.5 | |
| 4 | Large flocs, large and very obvious clumps. |

The results of the flocculation assessment for the fabric softener compositions 1-6, A and B are shown in Table 5.

TABLE 5

Flocculation scores and viscosities for the dilute fabric softeners 1-6, A and B.

| | Test water | | | Total floc | Viscosity at 106 $s^{-1}$, |
|---|---|---|---|---|---|
| Composition | W1 | W2 | W3 | score | 25° C. |
| A | 0 | 3 | 4 | 7 | 75 |
| B | 3 | 4 | 4 | 11 | 128 |

TABLE 5-continued

Flocculation scores and viscosities for the dilute fabric softeners 1-6, A and B.

| | Test water | | | Total floc | Viscosity at 106 $s^{-1}$, |
|---|---|---|---|---|---|
| Composition | W1 | W2 | W3 | score | 25° C. |
| 1 | 0 | 0.5 | 0.5 | 1 | 112 |
| 2 | 0 | 1.5 | 4 | 5.5 | 122 |
| 3 | 0 | 1.5 | 2.5 | 4 | 123 |
| 4 | 0 | 0 | 1.5 | 1.5 | 114 |
| 5 | 1.5 | 1.5 | 2.5 | 5.5 | 104 |
| 6 | 1 | 2 | 3 | 6 | 162 |

It will be seen that all of the fabric softeners which comprised TEAQ2 had a higher initial viscosity than that comprising TEAQ1.

It will further be seen that compositions 1-6 give dramatically reduced flocculation compared with the comparative examples.

Only the compositions in accordance with the invention give the combination of superior viscosity and low flocculation.

Example 3

Comparative Examples D, E and F

Further comparative examples, D, E and F were prepared in accordance with the prior art. A fully hardened quaternary ammonium active was used.

TABLE 6

Compositions of the liquid fabric softeners D, E and F

| Ingredient (wt %) | D | E | F |
|---|---|---|---|
| DEAQ[1] | 4.98 | 4.98 | 4.98 |
| Fatty alcohol[2] | 0.42 | 0.42 | 0.42 |
| Polymer[3] | 0.03 | 0.03 | 0.03 |
| Perfume | 0.34 | 0.34 | 0.34 |
| Dye | 0.001 | 0.001 | 0.001 |
| Preservative | 0.08 | 0.08 | 0.08 |
| Water | To 100 | To 100 | To 100 |
| Genapol C-200[4] | 2.0 | — | — |
| Tergitol 15-S-3[5] | — | 2.0 | — |

[1]Stepantex UL90, ex Stepan, (di(acyloxyehtyl) (2-hydroxyethyl) methyl ammonium methyl sulphate)
[2]Stenol 1618L, ex Cognis
[3]Natrasol 331, ex Hercules
[4]ex Clariant
[5]ex Dow

Example 4

Viscosities and Flocculation Behaviour of Comparative Examples D-F

Viscosities and flocculation properties were evaluated in the same way as described under Example 2 above. The results are given in Table 7 below:—

TABLE 7

Flocculation scores and viscosities for the dilute fabric softeners D, E and F.

| Composition | Test water W1 | W2 | W3 | Total floc score | Viscosity at 106 $s^{-1}$, 25° C. |
|---|---|---|---|---|---|
| D | 0 | 1 | 2 | 3 | 3.5 |
| E | 1 | 2 | 3 | 6 | 19 |
| F | 1.5 | 1.5 | 1.5 | 4.5 | 26 |

It will be seen that the viscosities of the compositions are low. The combination of high viscosity and low flocculation properties is not observed.

The invention claimed is:

1. An aqueous fabric conditioner composition comprising (a) from 2 to 9 wt % of a fabric softening active, by weight of the total composition, wherein the fabric softening active is an ester-linked quaternary ammonium compound having fatty acid chains comprising from 20 to 35 wt % of saturated C18 chains and from 20 to 35 wt % of monounsaturated C18 chains, by weight of total fatty acid chains;

(b) from 0.01 to 0.5 wt %, by weight of the total composition, of a floc prevention agent, wherein the floc prevention agent is a non-ionic alkoxylated material having an HLB value of from 8 to 18;

(c) at least 75 wt % water;

(d) fatty material selected from the group consisting of a fatty alcohol, a fatty acid, and mixtures thereof, and wherein the aqueous fabric conditioner composition has a viscosity of 100 to 200 cps as measured on a cup and bob viscometer; wherein the viscosity is determined based on a continuous measurement under shear at 106 $s^{-1}$ for 60 seconds at 25° C.

2. A composition as claimed in claim 1, wherein the fatty acid chains of the quaternary ammonium compound comprise from 25 to 30 wt % of saturated C18 chains and from 25 to 30 wt % of monounsaturated C18 chains, by weight of total fatty acid chains.

3. A composition as claimed in claim 1, wherein the fabric softening active is an ester-linked triethanolamine quaternary ammonium active compound.

4. A composition as claimed in claim 3, wherein the fabric softening active is an ester-linked triethanolamine quaternary ammonium active compound having an ester distribution comprising from 32 to 42% monoester, from 52 to 59% diester and from 5 to 9% triester compounds, by weight of total quaternary active.

5. A composition as claimed in claim 1, wherein the fatty material is a fatty alcohol.

6. A composition as claimed in claim 1, wherein the floc prevention agent is present in an amount of from 0.05 to 0.25 wt %.

7. A composition as claimed in claim 1, wherein the floc prevention agent is selected from addition products of (a) an alkoxide selected from ethylene oxide, propylene oxide and mixtures thereof with (b) a fatty material selected from fatty alcohols and fatty acids.

8. A composition as claimed in claim 1, wherein the floc prevention agent has an HLB value of from 11 to 16.

9. A composition as claimed in claim 1, which further comprises a polymeric thickening agent in an amount of below 0.4 wt %, by weight of the total composition.

10. A composition as claimed in claim 9, wherein the polymeric thickening agent is present in an amount of from 0.001 to 0.35 wt %, by weight of the total composition.

11. A composition as claimed in claim 9, wherein the polymeric thickening agent is cationic.

12. A method of preparing a rinse water, which comprises adding to water a composition as defined in claim 1.

13. The method of claim 12, wherein the water has a French Hardness value of 6 to 12° FH and a chloride:sulphate ratio of 3:1 to 2:1.

* * * * *